US007873176B2

(12) United States Patent
Pavlovic et al.

(10) Patent No.: US 7,873,176 B2
(45) Date of Patent: Jan. 18, 2011

(54) ELECTROSTATIC MICROPHONE

(75) Inventors: Gino Pavlovic, Vienna (AT); Richard Pribyl, Fischamend (AT)

(73) Assignee: AKG Acoustics GmbH, Vienna (AT)

( * ) Notice: Subject to any disclaimer, the term of this patent is extended or adjusted under 35 U.S.C. 154(b) by 409 days.

(21) Appl. No.: 12/148,456

(22) Filed: Apr. 18, 2008

(65) Prior Publication Data

US 2008/0273736 A1 Nov. 6, 2008

Related U.S. Application Data

(63) Continuation of application No. 10/150,753, filed on May 17, 2002, now abandoned.

(30) Foreign Application Priority Data

May 18, 2001 (AT) ..... A 797/2001

(51) Int. Cl.
*H04R 25/00* (2006.01)

(52) U.S. Cl. ..... 381/369; 381/173; 381/191

(58) Field of Classification Search ..... 381/355, 381/369, 173–176, 190–191
See application file for complete search history.

(56) References Cited

U.S. PATENT DOCUMENTS

| | | | | |
|---|---|---|---|---|
| 5,097,515 | A | 3/1992 | Baba | |
| 5,101,543 | A | 4/1992 | Cote et al. | |
| 6,678,383 | B2 * | 1/2004 | Ito et al. | 381/174 |

FOREIGN PATENT DOCUMENTS

| | | |
|---|---|---|
| CN | 1070532 | 3/1993 |
| JP | 58114600 | 7/1983 |
| JP | 11-331988 | 11/1999 |
| JP | 2000-83292 | 10/2001 |
| KR | 93-22576 | 8/1995 |

* cited by examiner

*Primary Examiner*—Suhan Ni

(57) ABSTRACT

An electrostatic microphone has a capsule housing and a diaphragm, a rigid electrode, and an electrical circuit on a printed circuit board arranged in the capsule housing. The diaphragm is connected to a ring shoulder provided on the front side of the capsule housing. Preferably, the capsule housing is divided into a housing bottom and a capsule lid, and the ring shoulder is provided on the capsule lid.

4 Claims, 1 Drawing Sheet

ELECTROSTATIC MICROPHONE

CROSS-REFERENCE TO RELATED APPLICATIONS

This application is a Continuation application of U.S. application Ser. No. 10/150,753 May 17, 2002 now abandoned.

BACKGROUND OF THE INVENTION

1. Field of the Invention

The invention relates to electrostatic microphones comprising a capsule housing in which a diaphragm and a rigid electrode as well as, optionally, a friction pill and an electric circuit on a printed circuit board are arranged.

2. Description of the Related Art

The invention thus relates to electroacoustic transducers which operate as sound receivers, are used as microphone capsules, and operate according to the electrostatic principle. Such transducers have, independent of their physical operating mode, a diaphragm which is exposed to a field of sound and is directly excited by it to vibrate.

The electrodes of the electrostatic transducer are an elastic, taut diaphragm and a stationary (rigid) electrode which is usually referred to simply as electrode. Both together form a capacitor whose electrical capacitance changes as a result of pressure fluctuations of the field of sound. Since an electric field is built up between the electrodes of the electrostatic transducer, it is possible to convert the capacitance changes of the transducer by means of an amplifier arranged downstream into electrical voltage changes.

Electrostatic capsules can be divided into two groups with respect to the type of application of the electrical field between its electrodes:

1. Electrostatic capsules in which the charges which generate the electrical field are applied by means of an externally supplied voltage (polarization voltage): capacitor capsules.

2. Electrostatic capsules in which the electrical charge is "frozen" on the electrode or diaphragm so that in this way an externally applied voltage is obsolete: electret capsule.

Such capsules are used in a series of applications in a an increasingly miniaturized form; reference is being had in this respect to mobile telephones or handsfree communication devices in vehicles and the like. The increasing miniaturization, in particular, in connection with the mass production of such capsules, requires the assembly as well as the principal configuration to be as economical as possible.

According to the prior art both capsule variants have the same type of configuration in common which is illustrated in FIG. 1. A diaphragm ring 2 is arranged in the capsule housing 1 on which a diaphragm 3 has been pretensioned and fastened. The diaphragm ring 2 must have a certain thickness because its task is to maintain the diaphragm 3 in the pretensioned state. This can be realized only with a thickness of the diaphragm ring starting approximately at 0.7 mm up to 2 mm. Moreover, the diaphragm together with the diaphragm ring should form a unit which is sufficiently robust in order to be processed automatically or manually. A spacer ring of material 4 having excellent insulating properties is introduced and placed onto the diaphragm ring.

By means of this spacer ring, the diaphragm and a rigid electrode 5 are maintained at a fixed distance of a few 10 μm. The electrode 5 which is placed onto the spacer ring 4 in the capsule housing forms the second electrode of the capacitor. It is manufactured of an electrically conducting material and has a perforation.

An acoustic friction 6 is arranged on the electrode 5. It is conventionally produced of plastic material by an injection molding process and has a hole or opening which is covered or closed by a porous material. The acoustic friction 6 serves for acoustic tuning of the microphone capsule relative to the frequency response curve of the output level and the pick-up characteristic of the capsule. The microphone capsule is closed at the rear by an electronic printed circuit 7 on which the electronic components which are necessary for the function of the capsule are arranged.

All of the components arranged in the described sequence on the diaphragm have openings in order to allow the sound to impact on the diaphragm also from the backside of the capsule, which is required for the acoustic tuning of the capsule including providing the desired directional dependency of the pick-up characteristic of the capsule.

SUMMARY OF THE INVENTION

It is an object of the present invention to reduce the number of components of such a microphone capsule and to simplify the configuration of the capsule without this resulting in a loss of quality.

In accordance with the present invention, this is achieved in that the diaphragm is connected with the front side of the capsule housing. For this purpose, the capsule housing is provided with an annular shoulder in the area of its front side onto which the diaphragm is mounted, preferably glued, in the stressed or taut state. For this purpose, an adhesive is applied onto the shoulder, for example, by means of a first plunger and, by means of a second plunger, the diaphragm, secured in the tensioned state on the second plunger, is pressed by the second plunger onto the shoulder and is glued onto the shoulder in this way. Subsequently, the spacer ring, the electrode, the friction pill, and the printed circuit board are introduced and mounted, so that, according to the invention, the previously required diaphragm ring is no longer needed.

DESCRIPTION OF THE PREFERRED EMBODIMENTS

Figure 1:
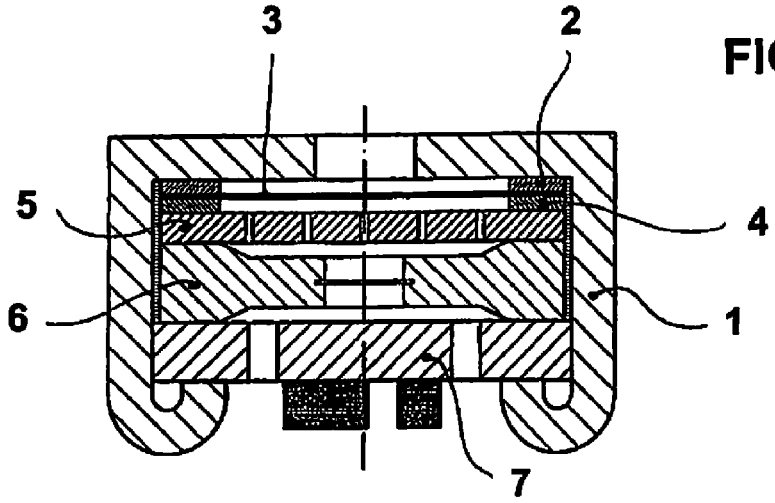
FIG. 1 shows a capsule according to the prior art.
Figure 2:
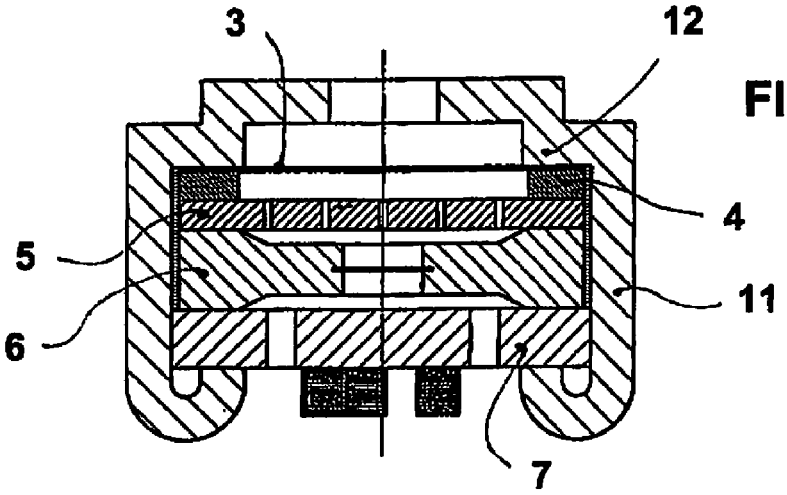
FIG. 2 shows a capsule according to the invention.

FIG. 2 illustrates the solution according to the invention. The microphone capsule housing 11 is provided with a step or inner shoulder 12 which makes it possible to eliminate the diaphragm ring. All other components of the microphone capsule according to the invention of FIG. 2 are identical to those of the capsule according to the prior art as illustrated in FIG. 1.

Since the capsule housing generally is produced by deep-drawing from sheet aluminum, it is no problem to form the shoulder 12 and to provide in this way an integrated "diaphragm ring" within the capsule housing in a single processing step. Since the total height of the resulting microphone capsule is even smaller than the height that was possible according to the prior art, such a capsule is more space-saving and cheaper than prior art capsules. Since the height (axial extension) of the microphone capsule according to FIG. 2 is only a few millimeters, the mounting of the diaphragm on the shoulder 12 in the interior of the capsule is no problem for a person skilled in the art. For this purpose, the diaphragm is introduced in a pre-tensioned state by a device into the microphone housing and is connected to it by gluing in a way known in the art.

Figure 3:
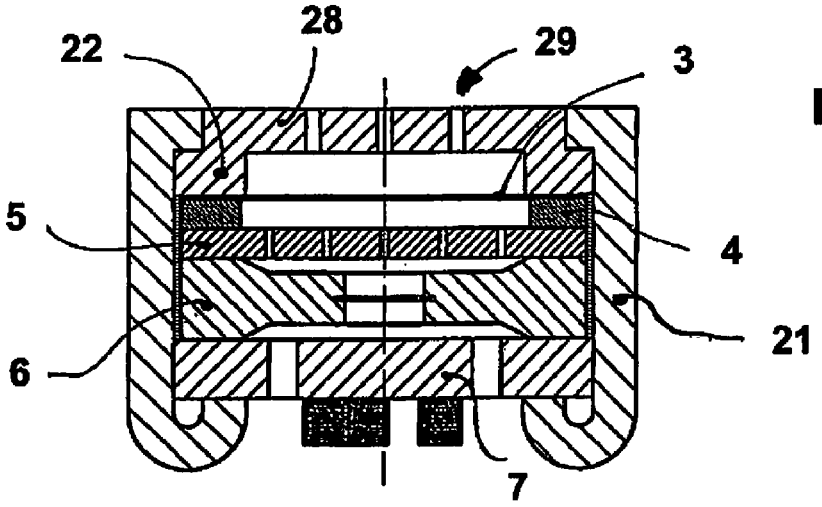
FIG. 3 shows a second embodiment of the capsule according to the invention.

Another embodiment of the invention is illustrated in FIG. 3. A capsule housing is illustrated here which differs from that of FIG. 2 in that the capsule housing is of a two-part configuration and is comprised of a housing bottom 21 and a capsule lid 28. The two-part configuration of the capsule housing can be found frequently for reasons of acoustic tuning, the reason being the following. The frequency response of a microphone capsule depends on the number and surface area of the sound openings 29 of the lid. For this reason, the capsule housing is frequently divided such that the attachment of different capsule lids 28 is possible. In this way, by simply exchanging the lid, different types of acoustic tuning of a capsule can be easily realized.

The invention enables with the illustrated configuration of the capsule lid with a shoulder 22 a cheaper manufacture of the entire microphone capsule. The microphone lid 22 may be comprised of, but must not be comprised of, the same material as the housing bottom 21. For example, it is possible to produce the capsule housing bottom of aluminum and the capsule housing lid of plastic material. It is also possible to divide the housing at a different location.

The invention is not limited to the illustrated and described embodiments but can be modified in various ways. For example, the possibility of achieving acoustic tuning by cooperation of the parts of the capsule with the parts of the device into which the capsule is introduced, which makes the friction pill unnecessary, has not been discussed.

The employed materials and technologies are unchanged relative to the prior art so that a person skilled in the art, in knowledge of the invention, will encounter no problems in realizing the invention.

Forming of the shoulder can be realized depending on the type of manufacture and material of the capsule or the capsule part which supports the shoulder. The drawings are not to scale so as to provide an easily recognizable illustration; reference is being had to the conventional dimensions of miniaturized capsules which, for example, have a total height and outer diameter of only a few millimeters, respectively.

In the case of the divided capsule housing, the connection between the two parts is possible in many different ways. All those connection are conceivable which are sufficiently stable, including frictional engagement as well as screwing or gluing.

While specific embodiments of the invention have been shown and described in detail to illustrate the inventive principles, it will be understood that the invention may be embodied otherwise without departing from such principles.

What is claimed is:

1. An electrostatic microphone comprising:

a capsule housing having a front side with a ring shoulder;

a diaphragm arranged in the capsule housing;

a rigid electrode arranged in the capsule housing;

an electrical circuit on a printed circuit board arranged in the capsule housing;

wherein the diaphragm is directly connected to the ring shoulder of the front side of the capsule housing.

2. The microphone according to claim 1, wherein the diaphragm is glued to the ring shoulder.

3. The microphone according to claim 1, wherein the capsule housing is comprised of a housing bottom and a capsule lid, wherein the capsule lid has the ring shoulder and wherein the diaphragm is connected to the ring shoulder.

4. The microphone according to claim 1, further comprising an acoustic friction arranged in the capsule housing.

* * * * *

UNITED STATES PATENT AND TRADEMARK OFFICE

CERTIFICATE OF CORRECTION

PATENT NO. : 7,873,176 B2
APPLICATION NO. : 12/148456
DATED : January 18, 2011
INVENTOR(S) : Pavlovic et al.

It is certified that error appears in the above-identified patent and that said Letters Patent is hereby corrected as shown below:

At column 3, line 22, "the capsule lid with..." should be changed to --the capsule lid 28 with...--.

At column 3, line 23, "...The microphone lid 22..." should be changed to --...The capsule lid 28...--.

Signed and Sealed this
Eleventh Day of October, 2011

David J. Kappos

David J. Kappos
*Director of the United States Patent and Trademark Office*